US006715854B2

(12) United States Patent
Hall

(10) Patent No.: US 6,715,854 B2
(45) Date of Patent: Apr. 6, 2004

(54) INSTALLING PRINTHEADS IN A HARDCOPY APPARATUS

(75) Inventor: Corrina Hall, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 225 days.

(21) Appl. No.: 09/984,933

(22) Filed: Oct. 31, 2001

(65) Prior Publication Data

US 2003/0081036 A1 May 1, 2003

(51) Int. Cl.[7] ..... B41J 29/393
(52) U.S. Cl. ..... 347/19
(58) Field of Search ..... 347/19, 23, 14, 347/85, 86, 16, 15, 12, 10, 11, 78; 358/1.9; 400/76; 399/59

(56) References Cited

U.S. PATENT DOCUMENTS 5,835,108 A * 11/1998 Beauchamp et al. ..... 347/19
6,278,468 B1 * 8/2001 Watrobski et al. ..... 347/19

* cited by examiner

*Primary Examiner*—Stephen Meier
*Assistant Examiner*—Charles Stewart

(57) ABSTRACT

A printhead for a hardcopy apparatus is calibrated by a separate device before being installed in the hardcopy apparatus. The calibration information produced is stored in a memory located in the printhead, in the device, in the hardcopy apparatus or in an external device. A carriage and several printheads may be calibrated simultaneously.

16 Claims, 2 Drawing Sheets

INSTALLING PRINTHEADS IN A HARDCOPY APPARATUS

FIELD OF THE INVENTION

The present invention relates to installing printheads in a hardcopy apparatus. In particular the present invention relates to preparing for use one or more replacement printheads in a printer.

BACKGROUND OF THE INVENTION

When a hardcopy apparatus is in use, it may become necessary to replace a printhead. This may be due to a printhead cartridge running out of ink. Alternatively, it may be due to the printhead becoming defective, for example the number of blocked nozzles has exceeded a predetermined number.

With conventional hardcopy apparatus, when it is necessary to replace a printhead, the existing printhead is removed, the replacement printhead is inserted and then specific routines are undertaken to ensure that the printhead will operate satisfactorily in the apparatus.

Specific examples of these routines are:

Routines to determine whether the printhead has been used before;

Energy routines to determine the electrical characteristics of the printhead and modify the signal to the printhead to ensure optimal performance;

Start-up routines to ensure that all nozzles are firing and that they are firing correctly.

Routines to ensure nozzle alignment with the other printheads;

Routines to ensure color calibration with the other printheads.

The time during which these routines are undertaken represents downtime for the hardcopy apparatus. For example, for large format printers and industrial printers the downtime can amount to as long as twenty minutes. Thus printhead replacement is a costly exercise for the user, especially for expensive industrial hardcopy apparatus and hardcopy apparatus subject to heavy use.

Failure to perform the above routines causes a reduction in print quality.

SUMMARY OF THE INVENTION

Certain aspects of the present invention seek to overcome or reduce the above problems.

According to a first aspect of the present invention, there is provided a method of installing at least one printhead in a hardcopy apparatus, wherein said printhead is subjected to a calibration and/or start up procedure before it is installed in the hardcopy apparatus.

According to a second aspect of the present invention, there is provided a method of installing a plurality of printheads in a hardcopy apparatus, wherein the printheads are subjected to a calibration procedure relative to each other before they are inserted in the hardcopy apparatus.

According to a third aspect of the present invention, there is provided a method of installing a carriage with one or more printheads mounted in said carriage in a hardcopy apparatus, wherein the printheads mounted in said carriage are subjected to a calibration procedure before the carriage is installed in the hardcopy apparatus.

According to a fourth aspect of the present invention, there is provided a device for calibrating at least one printhead for a hardcopy apparatus, said device including a memory and means for subjecting said printhead to a calibration process, said calibration process producing calibration information, said calibration information being stored in said memory.

According to a fifth aspect of the present invention, there is provided a system for calibrating at least one printhead for a hardcopy apparatus, said system comprising a device including means for subjecting said printhead to a calibration process, said calibration process producing calibration information, and said system further including an external device, said external device including a memory, said calibration information being stored in said memory.

According to a sixth aspect of the invention, there is provided a system for calibrating at least one printhead, said system comprising a device including means for subjecting said printhead to a calibration process, said calibration process producing calibration information, and said system further including a hardcopy apparatus suitable for receiving said printhead, said hardcopy apparatus including a memory, said calibration information being stored in said memory.

According to a seventh aspect of the present invention, there is provided a device for calibrating one or more printheads for a hardcopy apparatus, said device including means for receiving a carriage with said printhead(s) mounted therein, a memory, and means for subjecting the printhead(s) mounted in said carriage to a calibration procedure, said procedure producing calibration information, said calibration information being stored in said memory.

BRIEF DESCRIPTION OF THE DRAWINGS

Preferred embodiments of the present invention will now be described, by way of example only, with reference to the accompanying drawings, of which.

DETAILED DESCRIPTION OF PREFERRED EMBODIMENTS

Figure 1:
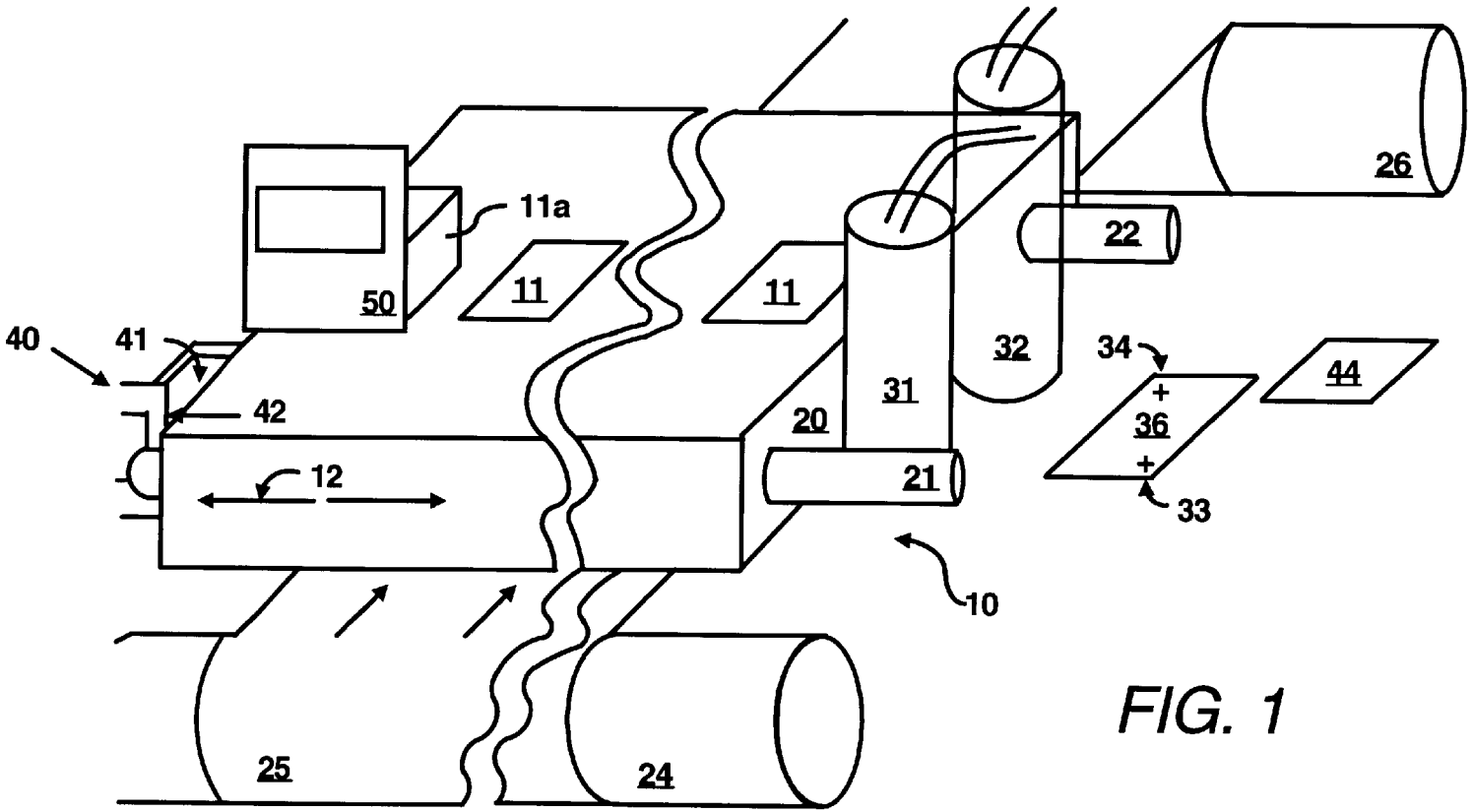
FIG. 1 is a schematic, perspective view of a peripheral device in accordance with an embodiment of the present invention.

Referring to the drawings, FIG. 1 shows a peripheral device 10 in accordance with the present invention. Basically, the device 10 resembles the corresponding parts of an ink-jet printer in which a printhead is to be inserted. The replacement printhead is first inserted in a corresponding printhead pocket 11 of the device 10. The printhead incorporates its own memory. The necessary calibration and/or start up routines are then applied to the printhead while it is in pocket 11. The printhead is then removed from pocket 11 and inserted in an inkjet printer ready for use.

Device 10 comprises a carriage 20 which is displaceable in a scan direction 12 along slider rods 21, 22. Pockets 11 are provided to receive printheads to be prepared for subsequent use. It will be appreciated that although only two pockets 11 are shown, any number of pockets may be provided, depending upon the number of printheads it is desired to prepare. Each pocket 11 contains datums, fluid interconnects, electrical connections and a latch to secure the printhead in place.

A media supply roller 24 feeds print media 25 to a media take-up roller 26 and nozzles of the printheads deposit ink on the media as it passes underneath the carriage 20. LED sensors 31, 32 are mounted on carriage 20 to scan the ink deposited on media 25 by the printhead nozzles. Any desired number of LED sensors may be provided. Part of the path of each of the LED sensors 31, 32 lies over a respective registration mark 33, 34 on a reticule 36. Reticule 36 is mounted on a fixed part of the device 10 and is calibrated during manufacture of the device to a known relationship with the datums of the print pockets 11.

A service station 40 is provided for the printheads inserted in the device 10. Service station 40 comprises a spittoon 41 and wipers 42 for each of the printheads, the wipers being provided with a drive system to move them relative to the printers. A cap 44 is provided for each of the printheads. Depending on the printhead to be serviced, the cap may be used for priming.

The device 10 further comprises an electronics board 50, incorporating a central processing unit (C.P.U.).

In use of the device 10, one or more printheads to be used in an inkjet printer are first inserted in pockets 11. The preparation of a single printhead will first be described. At the completion of the insertion, the printhead is connected electrically (power and memory chip to the electronics board 50) and is aligned and held firmly in place through mechanical means. The pocket 11 and associated latch undertake these operations.

The following routines are then undertaken:

1. New Printhead Detection and Servicing

Check if the printhead is a new or used printhead. If it is a used printhead, then skip operation 1a (Turn on energy) and perform a Servicing routine for a used pen. This consists of firing a prescribed number of drops from each printhead and wiping the printhead to assure cleanliness.

If it is a new pen, perform the following steps:

1a) Printhead energy algorithm

Perform printhead energy algorithm to assure enough energy is given to all nozzles in the printhead so each one fires a drop. Store the information of printhead energy for use during printing. This may be done through encoding this into the memory of the printhead, by sending the information to the device CPU which then sends it to the printer software, or though any other information storage and retrieval system such that the information is usable by the printer when it is time to print with the printhead.

1b) Servicing routine for a new or used pen

Initiate a servicing routine consisting of firing a prescribed number of drops from each printhead into the spittoon 41 or onto the media 25 and wiping the printhead to assure cleanliness.

2. Nozzle Health Check

Check the nozzle health—i.e. for detecting missing or severely mis-directed nozzles. This can be done by firing onto the media 25 and scanning the resulting pattern with the LED sensors 31, 32. If the number of missing or defective nozzles exceeds a pre-set threshold, the pen is serviced using the primer and wiper. After these operations, nozzle health checking is repeated.

Store the information of nozzle health for use during printing. This may be done through encoding this into the memory of the printhead, by sending the information to the device CPU which then sends it to the printer software, or though any other information storage and retrieval system such that the information is usable by the printing machine when it is time to print with this printhead.

3. Nozzle and Printhead Alignment

Precise location of the printhead relative to the device 10 occurs through firmly holding the printhead without deflecting it. Alignment is achieved by using algorithms which are similar to the algorithms used in existing printers.

The method used for printhead alignment is to align it to the precisely-located reticule 36 with registration marks 33, 34. The sensors 31, 32 scan this reticule and store the locations of the registration marks 33, 34. All alignments are done with respect to these registration marks. The inserted printhead prints a pattern which gives the following information:

Nozzle position with respect to the registration marks 33, 34 of the reticule.

Overall swath height with respect to the registration marks 33, 34.

Absolute distance of the odd/even separation of the nozzles for a given scanning speed of the carriage 20.

Other operations may be performed according to the specific algorithms for a given printhead. In other words, the device should be capable to be upgraded to accommodate new algorithms as new printheads are developed.

Since the alignment is dependent on a good location of the printhead with respect to the datum, the above procedure may be performed a number of times and the device will calculate the average value of the positions for each of the different printhead insertions. This average will be used for nozzle and printhead to printhead alignment during actual printing in the inkjet printer.

4. Color Calibration

Color calibration is performed in a fashion similar to the way in which the color calibration is performed on a conventional printer when all the printheads are mounted. Patterns are printed with a variety of densities. The device 10 correlates the printed optical density to known optical densities printed with known printheads and records an adjustment factor for that printhead.

As with the other information relating to the printhead, the information for alignment and color calibration are stored for use during printing. This may be done through encoding this into the memory of the printhead, by sending the information to the device CPU which then sends it to the printer software, or though any other information storage and retrieval system such that the information is usable by the printer when it is time to print with this printhead.

An advantage of the above-described arrangement is that a user does not have to wait for the operations to be performed by the printer when a printhead is replaced. The printer need only be stopped long enough to replace a printhead and yet it has all the operations listed already done when it is replaced. Printing can begin immediately. With embodiments of the present invention, downtime is minimized. Downtime during printhead replacement is a severe problem for printing machines that are in high usage or which have a very high acquisition cost.

Figure 2:
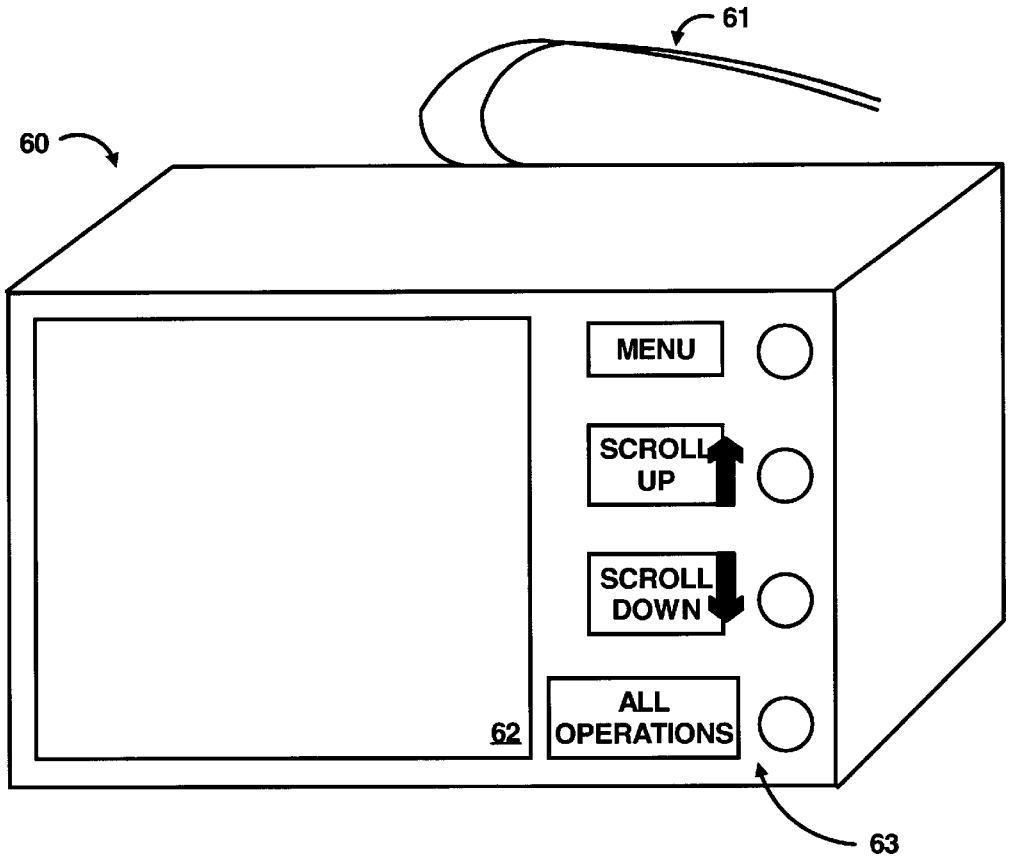
FIG. 2 is a perspective view of a user interface for use with embodiments of the present invention.

Use of the device can even be an advantage in association with printers which are not in heavy use or with relatively low-cost printers since it enables a quicker restart of printing than the prior art. A single device 10 may be used in turn to set-up printheads for a plurality of different printers. The device 10 may actually be constituted by a special printer kept for this purpose. The method could be performed by having a printer in a print room but which is not used for actually printing Various modifications may be made to the above-described arrangement. In particular, although the device 10 shown in FIG. 1 has so far been described as a stand-alone device, it may be used in conjunction with the user interface device 60 shown in FIG. 2. The user interface device 60 is connected to device 10 via input/output cables 61. Device 60 has a display 62 and a panel 63 with which a user may send instructions to device 10. The user may select an automatic mode. Alternatively the user may select instructions from a menu. The instructions may include an indication of whether a full calibration routine is to be implemented or only a partial routine or only a start-up operation. The instructions may include the type of printhead and/or the type of printer in which the printhead is to be installed. The user interface device 60 may be used to store information during the calibration by device 10 for subsequent supply to the printer. This will be explained in more detail later in connection with FIG. 3.

Instead of using reticule 36, a different method may be employed to achieve printhead alignment. One alternative method involves the use of a so-called "golden pen" 11*a* which is a printhead or other marking device which is used as a "master" for calibrating the position of the printheads which are inserted in device 10 and which are subsequently removed. Except for periodic maintenance or replacement the golden pen remains installed in device 10, e.g. in a respective pocket 11. The golden pen is highly-accurately machined and is predictable under environmental changes. In use, the golden pen prints a pattern with each alignment and the inserted printheads each print a similar pattern, which gives the following information:

Nozzle position with respect to the pattern printed by the "golden pen".

Overall swath height with respect to the "golden pen".

Absolute distance of the odd/even separation of the nozzles for a given scanning speed of the carriage.

Whether the reticule 36 or the golden pen method is employed the device needs to be calibrated periodically. This can be done during a normal servicing of the printer or through contacting a service technician. For either method of alignment, the reticule 36 or the "golden pen", is reset to have precise alignment to the device printhead datum in the device printhead pocket 11.

The printheads and the golden pen when used, may incorporate their own ink supply or have ink supply tubing attached thereto.

The printheads may not have their own memories, in which case the calibration information is stored elsewhere, e.g. in the CPU in board 50, in the printer where the printhead is to be installed, in the user interface 60, or elsewhere.

The arrangements described so far have printheads where the nozzle arrangements is parallel to the media movement and the operation of printing is done by scanning the head over the media for successive passes. However, the printheads may have their nozzles arranged perpendicular to the media axis. Here, the operation of printing is done by keeping the printheads fixed while the media moves perpendicularly to the array of nozzles. The device 10 is particularly advantageous for calibrating a printbar corresponding to a page wide array since this calibration process can be lengthy.

In an alternative color calibration process, the printhead is calibrated analytically to an absolute scale of densities or L*A*B* values.

Other types of sensors than the LED sensors 31, 32 may be employed. For example the detection of the presence or non-presence of a drop may be performed electronically, visually, or by the use of sound. In each case, the appropriate detector is mounted on device 10 beneath the printheads. The electronic circuitry to operate the sensors may be mounted on the carriage 20 (e.g. on board 50) or elsewhere.

Although carriage 20 may be constructed similarly to a printer carriage, it may alternatively have a relatively heavy-duty construction to allow the frequent replacement of printheads without deterioration in accuracy of performance. The electrical interconnect arrangement may also be different.

Although described in connection with an inkjet printer, device 10 may be used in connection with other forms of printer. Moreover, it can also be used in connection with other types of hardcopy apparatus including plotters, photocopiers, facsimile machines and scanners.

Figure 3:
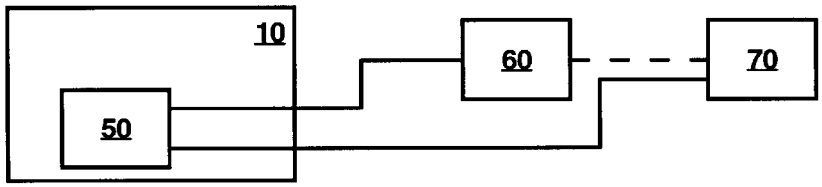
FIG. 3 is a block diagram indicating the connections between components of apparatus according to the present invention.

FIG. 3 shows the connections in a system comprising a calibration and/or set up device 10 with its own electronics board 50, a user interface device 60 and a printer 70. The calibration information can be sent directly by board 50 to the printer 70. Alternatively the calibration information may be stored in device 60 and forwarded to printer 70 subsequently. For example, at the time of calibrating the printhead, it may not yet be known for which printer it is intended. One of the types of information which it is particularly advantageous to store in device 60 in this way is so-called "mask reshuffle" data where the printing instructions for the nozzles need to be modified to account for defective nozzles. The supply by device 60 to the printer of this information saves time, after installation of the printhead in the printer, since the printer no longer needs to process the mask reshuffle.

If desired, a short calibration procedure for an inserted printhead may still be undertaken by the printer. For example, it can be useful to check the alignment of the printhead and to take any necessary correction in case an error has been introduced during the transfer of the printhead.

Device 10 may be used to undertake a calibration routine and a start-up routine or only a start-up routine. Performing both routines is preferred since, even if the printhead was correctly calibrated during manufacture, it is possible that changes occurred during transport and storage. At least a start up procedure should be undertaken since this prepares the printhead for immediate use. It is possible for device 10 to undertake the calibration procedure and for the printer to undertake the start-up procedure, although this does not save as much time as with the preferred embodiment. The start-up procedure may include setting-up the printhead for a particular power supply environment at its location of use.

Device 10 may handle a plurality of printheads at the same time e.g. a black printhead and three color printheads or a black printhead and five color printheads. A suitable number of pockets 11 are provided. The printheads may be calibrated independently of one another. Alternatively, the characteristics of one or more of the printheads may be taken into account when calibrating one or more of the other printheads. For example, in operation of a four printhead printer, one of the printheads may need to be exchanged for a new one. In this case all four printheads are removed from the printer, the defective one is disposed of, and the three other printheads together with a new printhead, of appropriate type, are inserted in respective pockets 11 of device 10. The new printhead is then calibrated taking into account the existing characteristics of the three printheads; for example it is known that drop volumes can change with age. Alternatively, all four printheads could be completely recalibrated. The particular choice of procedure can be selected by user interface device 60.

Similarly any number of nozzle arrays or modules, or printheads may be calibrated together.

In a final modification, a printer carriage and all its printheads are calibrated together, removed together from device 10 and then inserted together by mounting the carriage in the printer. The old printer carriage can then be used as the carriage 20 on device 10. Total carriage replacement has the advantage that no loss of alignment occurs due to physical transfer of the printheads from the device 10 to the printer. In addition alignment can be performed in a relative manner without using a separate standard such as reticule 36 or the golden pen. Moreover, color calibration can also be undertaken on a relative basis and all colors may be balanced at once.

Total carriage replacement can be used even in the event of failure of only a single printhead. If the printer has a carriage which can relatively quickly be removed and replaced, this may be a quicker operation than replacing the faulty printhead and then calibrating it and starting it up in the printer.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method of the installing at least one printhead in a hardcopy apparatus, wherein said printhead is subjected to calibration and/or start up procedure before it is installed in the hardcopy apparatus, wherein the printhead includes a memory, and said printhead is subjected to a calibration process, said calibration process producing calibration information, said calibration information being stored in said memory.

2. A method of the installing at least one printhead in a hardcopy apparatus, wherein said printhead is subjected to calibration and/or start up procedure before it is installed in the hardcopy apparatus, wherein the calibration and/or start up procedure is performed by a device, said device having a movable carriage for mounting said printhead.

3. The method of claim 2, wherein the carriage includes a memory, and the printhead is subjected to a calibration process, said calibration process producing calibration information, said calibration information being stored in said memory.

4. The method of claim 2, wherein the carriage is connected to an external device, said external device including a memory, and the printhead is subjected to a calibration process, said calibration process producing calibration information, said calibration information being stored in said memory.

5. The method of claim 2, wherein said hardcopy apparatus including a memory, and the printhead is subjected to a calibration process, said calibration process producing calibration information, said calibration information being stored in said memory.

6. The method of the installing at least one printhead in a hardcopy apparatus, wherein said printhead is subjected to calibration and/or start up procedure before it is installed in the hardcopy apparatus, wherein the printhead is subjected to a calibration and start up procedure comprising the steps of detecting whether said printhead is a new or used printhead, and if said printhead is new performing an energy algorithm thereon, subjecting the printhead to a servicing routine, checking the operation of the printhead by causing it to eject ink and monitoring the result to obtain first calibration information, using sensors to determine the alignment of said printhead with a fixed datum to obtain second calibration information, subjecting the printhead to a color calibration process to obtain third calibration information, and storing in memory said first, second and third calibration information.

7. The method of the installing at least one printhead in a hardcopy apparatus, wherein said printhead is subjected to calibration and/or start up procedure before it is installed in the hardcopy apparatus, wherein the printhead is subjected to a calibration and start up procedure comprising the steps of detecting whether said printhead is a new or used printhead, and if said printhead is new performing an energy algorithm thereon, subjecting the printhead to a servicing routine, checking the operation of the printhead by causing it to eject ink and monitoring the result to obtain first calibration information, providing a marker device, causing said marker device to eject ink on to a print media, causing said printhead to eject ink on to said print media, comparing the locations of ink on the media to obtain second calibration information relating to the alignment of the printhead, subjecting the printhead to a color calibration process to obtain third calibration information, and storing in memory said first, second and third calibration information.

8. A method of installing a plurality of printheads in a hardcopy apparatus, wherein the printheads are subjected to a calibration procedure relative to each other before they are inserted in the hardcopy apparatus, wherein the printheads include a memory, said calibration process producing calibration information, said calibration information being stored in said memory.

9. The method of claim 8, wherein the calibration procedure is performed by a device, said device having a movable carriage for mounting said printheads.

10. A method of installing a carriage with one or more printheads mounted in said carriage in a hardcopy apparatus, wherein the printheads mounted in said carriage are subjected to a calibration procedure before the carriage is installed in the hardcopy apparatus, wherein the printheads include a memory, said calibration process producing calibration information, said calibration information being stored in said memory.

11. A device for calibrating at least one printhead for a hardcopy apparatus, said device including a memory and means for subjecting said printhead to a calibration process, said calibration process producing calibration information, said calibration information being stored in said memory.

12. A device of for calibrating at least one printhead for a hardcopy apparatus, said device including a memory and means for subjecting said printhead to a calibration process, said calibration process producing calibration information, said calibration information being stored in said memory, wherein said device includes a movable carriage for mounting said printhead, means for moving a print media past said printhead, means for causing said printhead to deposit ink on said print media, and means for sensing the deposition of ink on the media.

13. A system for calibrating at least one printhead for a hardcopy apparatus, said system comprising a device including means for subjecting said printhead to a calibration process, said calibration process producing calibration information, and said system further including an external device, said external device including a memory, said calibration information being stored in said memory.

14. A system according to claim 13, wherein said external device is operable by a user.

15. A system for calibrating at least one printhead, said system comprising a device including means for subjecting said printhead to a calibration process, said calibration process producing calibration information, and said system further including a hardcopy apparatus suitable for receiving said printhead, said hardcopy apparatus including a memory, said calibration information being stored in said memory.

16. A device for calibrating one or more printheads for a hardcopy apparatus, said device including means for receiving a carriage with said printhead(s) mounted therein, a memory, and means for subjecting the printhead(s) mounted in said carriage to a calibration procedure, said procedure producing calibration information, said calibration information being stored in said memory.

* * * * *